United States Patent [19]

Tokunaga et al.

[11] 4,164,418

[45] Aug. 14, 1979

[54] METHOD OF RECOVERING VALUABLE METALS FROM ZINC BEARING MATERIALS AND BLAST FURNACE RELEVANT THERETO

[75] Inventors: Hiroshi Tokunaga, Tokyo; Yoshikazu Tatehana; Akira Umekawa, both of Ohmuta, all of Japan

[73] Assignee: Mitsui Mining & Smelting Co., Ltd., Tokyo, Japan

[21] Appl. No.: 835,338

[22] Filed: Sep. 21, 1977

Related U.S. Application Data

[62] Division of Ser. No. 710,465, Aug. 2, 1976, Pat. No. 4,071,228.

[51] Int. Cl.[2] ..... C22B 19/08

[52] U.S. Cl. ..... 75/88

[58] Field of Search ..... 75/14, 86, 87, 88, 92

[56] References Cited

U.S. PATENT DOCUMENTS 701,458 6/1902 Armstrong ..... 75/87

*Primary Examiner*—M. J. Andrews

*Attorney, Agent, or Firm*—Blanchard, Flynn, Thiel, Boutell & Tanis

[57] ABSTRACT

The blast furnace in the present invention comprises a V-shaped or an inclined hearth, tuyeres disposed along said hearth, a tap hole for discharging matte and/or slag, said tap hole being disposed at the lowest part of the hearth, and dampers having V-shaped or inclined fore end, each of said dampers being disposed to agree with said tuyeres. The present blast furnace, when employed for smelting by feeding briquetted Zn bearing materials as the material thereto and blowing preheated air therein through the tuyeres disposed along the hearth, displays an improved smelting efficiency in separating and recovering volatile valuable metals and non-volatile valuable metals.

10 Claims, 7 Drawing Figures

VERTICAL RETORT RESIDUE
VIBRATING SCREEN
OVERSIZE
UNDERSIZE
STORAGE BIN
CFW
LIGNO SULFITE LIQUOR
COAL FINE
ELCTROLYTIC LEACH RESIDUE
Cu-BEARING Zn DROSS AND OTHERS
PADDLE MIXER
ROTARY DRIER
ROD MILL
CHASER

METHOD OF RECOVERING VALUABLE METALS FROM ZINC BEARING MATERIALS AND BLAST FURNACE RELEVANT THERETO

This is a division of application Ser. No. 710,465, filed Aug. 2, 1976, now U.S. Pat. No. 4,071,228.

BACKGROUND OF THE INVENTION

1. Field of the Invention

The present invention relates to a method of smelting Zn bearing materials from Zn smelting plants and other sources by the use of a blast furnace (=MF furnace) and separating and recovering volatile valuable metals like zinc, cadmium, etc. as well as non-volatile valuable metals like gold, silver, copper, etc., together with an apparatus for practicing said method. Particularly it relates to a method and an apparatus for smelting Zn bearing materials which comprises blowing air into a blast furnace having a V-shaped or inclined hearth through tuyeres disposed along said hearth.

2. Description of the Prior Art

The residues from zinc smelting plants are generally classified into two classes, namely, a residue arising from the pyrometallurgical smelting process, such as the horizontal retort distillation process, the vertical retort distillation process and electric thermal distillation process, and a zinc leaching residue, to wit, the so-called 'red residue' arising from the hydrometallurgical smelting process. Further, as other residues containing zinc, there are various kinds of dusts, such as fumed dust from open hearth, the converters, rotary kilns, etc. employed for iron manufacturing, the dust arising from copper ore smelting, hydrolysis cake, etc. These zinc bearing materials contain valuable metals such as Zn, Fe, Pb, Cu, Cd, Ag, Au, etc. From the view point of the effective use of resources as well as the prevention of environmental pollution ascribable to heavy metals contained in accumulated stocks, development of an appropriate method of recovering valuable metals contained in these materials has been long hoped for. As methods of recovering valuable metals contained in these zinc bearing materials, there are known the Jarosite method, the sulfatizing roasting method, etc. for hydrometallurgical leaching residues and the like, and for the residues arising from the pyrometallurgical smelting process, there are known a method of treating it by adding a reducing agent and using a rotary kiln as well as a blast furnace, etc.

The present inventor has previously proposed in Japanese Patent Publication No. 6681/1971 a method of smelting complex ores by the use of a blast furnace, said method being characterized in that, at the time of treating a complex ore containing Cu, Pb, Zn and other valuable metals by the use of a blast furnace, the thickness of the layer of the material is reduced or the feed is subjected to pre-heating or coking beforehand, preheated or oxygen-rich air is blown in by way of the vicinity of the tap hole, the melt is continuously discharged without accumulating it on the hearth thereby to emit a part of the furnace gas through the tap hole, and the smelting zone is maintained at a temperature of more than 1,300° C. sufficient for reducing a part of the iron contained in the ore to metallic iron. As the blast furnace for use in this method, he has proposed a blast furnace intended for collectively enhancing the volatilization efficiency of zinc and improving the yield of metallic lead, said furnace being characterized in that, the furnace is of an ample length and provided with a weir disposed in the center of the hearth and outside the reach of the air blown in through the tuyeres, different kinds of ores mixed at an appropriate ratio are to be fed by way of the two sides of the furnace, the melt that forms in the vicinity of tuyeres of both sides is discharged through the tap hole of the respective side of the furnace so as not to get mixed together, and in order to recover oxides containing lead, tin and cadmium as well as zinc oxide or metallic zinc of high purity through a single stage, at the time of pre-heating or coking the ore material, a part of the waste gas in the furnace is separately led to the outside of the furnace and brought in contact with said ore material whereby the pre-heating or coking of the ore material is performed by using the waste gas without causing a reduction of the temperature of the overhead portion of the furnace.

More recently, the present inventor has proposed in Japanese Patent Publication No. 37889/1973 a method of smelting which comprises briquetting powder zinc leaching residue by adding a reducing agent thereto, subjecting the resulting briquetted ore to coking treatment within a coking chamber communicating with a blast furnace, feeding the thus coked material to the blast furnace in the form of a thin layer of material, blowing pre-heated air into the furnace from the lower part thereof close to the hearth and blowing secondary air into the overhead clearance within the furnace, maintaining the temperature of the surface of the layer of material as well as the reaction zone within the furnace at a specified temperature by regulating the amount of supply of the briquetted ore as well as the combustion within said clearance, recovering volatile valuable metals by effecting oxidation and combustion within the clearance, and recovering the non-volatile valuable metals in the form of matte by constantly emitting a part of the air blown into the furnace through the tap hole.

However, these methods of smelting in the prior art have drawbacks attributable to the employment of a blast furnace having the datum line of the tuyeres disposed horizontally, such as follows:

1. There occurs a difference of smelting speed between the two side parts along the length of the furnace and the central part thereof, and particularly the smelting speed of said two side parts is apt to slow down.

2. In the case where the strength of the briquetted ore is insufficient or the feed of ore material is increased, there occurs the so-called 'dead' phenomenon in which the blowing of air into the two side parts through the tuyeres becomes impossible.

3. There are instances wherein clogging occurs in the tuyeres located on the two side parts of the furnace.

4. As to the smelting efficiency, using a furnace having a length of 4.2 m and equipped with single-sided tuyeres, the efficiency attained thereby is no more than 80 t/day in terms of ore material disposed of per unit furnace, and yet, enlargement of the size of furnace, and particularly lengthwise extension thereof, is difficult.

SUMMARY OF THE INVENTION

The object of the present invention is to eliminate the above described drawbacks in the prior art.

Another object of the present invention is to provide a blast furnace comprising a V-shaped or an inclined hearth, tuyeres disposed along said hearth, a tap hole for discharging matte and/or slag, said tap hole being disposed at the lowest part of the tuyere, and dampers having a V-shaped or inclined fore end, whereby a satisfactory smelting reaction is maintained even in the two side parts along the length of the furnace and a delay of the smelting reaction such as is observed in the prior art can be eliminated.

A further object of the present invention is to make uniform the smelting reaction within the furnace in particular by inclining the datum line of the V-shaped or inclined tuyeres to the extent of 2–10 degrees.

A still further object of the present invention is to provide a blast furnace capable of effectively utilizing waste heat by virtue of the provision of a secondary air supply hole disposed in the upper part of the furnace, a waste heat recovering means communicating with the overhead clearance within the furnace and a zinc oxide recovering means connected to said waste heat recovering means.

Still another object of the present invention is to collect volatile valuable metals at a high yield by virtue of the employment of a high-pressure steam generating boiler as the waste heat recovering means thereby to generate a high-pressure steam and the employment of a bag-house as the zinc oxide recovering means thereby to collect volatile valuable metals.

An additional object of the present invention is to provide a method of smelting comprising subjecting a briquetted ore material to coking, feeding the thus coked ore material to a blast furnace having a V-shaped or inclined bottom, and performing the smelting while blowing pre-heated air into the furnace through tuyeres disposed along the bottom thereof, whereby the smelting efficiency per unit length of furnace is improved, occurrence of delay of the smelting reaction in the vicinity of tuyeres disposed in the side parts along the length of furnace is eliminated and separation and recovery of volatile valuable metals as well as non-volatile valuable metals is performed satisfactorily.

Yet another object of the present invention is to improve drastically the recovery of the heat of waste gas arising from the blast furnace by introducing said waste gas into a waste heat recovering means, generating high-pressure steam by utilizing the heat of the waste gas therein, pre-heating the air to be blown into the furnace with a part of said high-pressure steam and generating electricity with a high-pressure turbine by using the remainder of said high-pressure steam.

Still an additional object of the present invention is to improve the crushing strength of the briquette and enhance the treating efficiency of the blast furnace through the process comprising sifting the residue arising from the pyrometallurgical smelting of zinc by means of a sieve having meshes of 25–40 mm, adding 80–100% by volume of the gross amount of ligno-sulfite liquor employed to the undersized residue and mixing them together so as to obtain a mixture equivalent to 7–22% based on the total undersized residue, adding the remaining ligno-sulfite liquor to this mixture and then putting the mixture in a first rotary drier to subject it to a primary mixing so as to attain a water content of 18–22%, putting the mixture after the primary mixing in a second rotary drier together with hydrometallurgical zinc leaching residue, other zinc materials and fine coal thereby effecting the secondary mixing so as to attain a water content of 15–20%, crushing the mixture after said secondary mixing with a rod mill, kneading the thus crushed mixture with a kneader, briquetting the kneaded mixture, and feeding the resulting briquette together with the oversize lumps in a blast furnace as the feed material.

A particular object of the present invention is to render it possible to perform the smelting reaction satisfactorily by virtue of preheating the air to be blown in through the tuyeres up to a temperature of 450° C. or more, maintaining the temperature of the reaction zone within the furnace at 1,300° C. or more and also maintaining the surface temperature of the layer of ore within the furnace at 500° C. or more.

DETAILED DESCRIPTION OF THE INVENTION

The present invention relates to a blast furnace equipped with a coking chamber connected thereto, which is characterized in that the hearth thereof is V-shaped or inclined, tuyeres are disposed along said hearth, and a tap hole for discharging slag and/or matte is disposed at the lowest part of the tuyeres. By virtue of such a structure of the tuyeres for blast furnace as described above, the present invention can drastically improve the smelting efficiency per unit length of the furnace compared with that of the conventional furnaces.

With the improvement of the smelting efficiency as stated above, coupled with the generation of hot blast by means of the recovered high-pressure steam and the supply of said hot blast to a high-pressure steam turbine, the heat recovery is also greatly enhanced and a very profitable effect is brought about by the present invention.

Hereunder will be given a further elucidation of the present invention by reference to the appended drawings.

Figure 1:
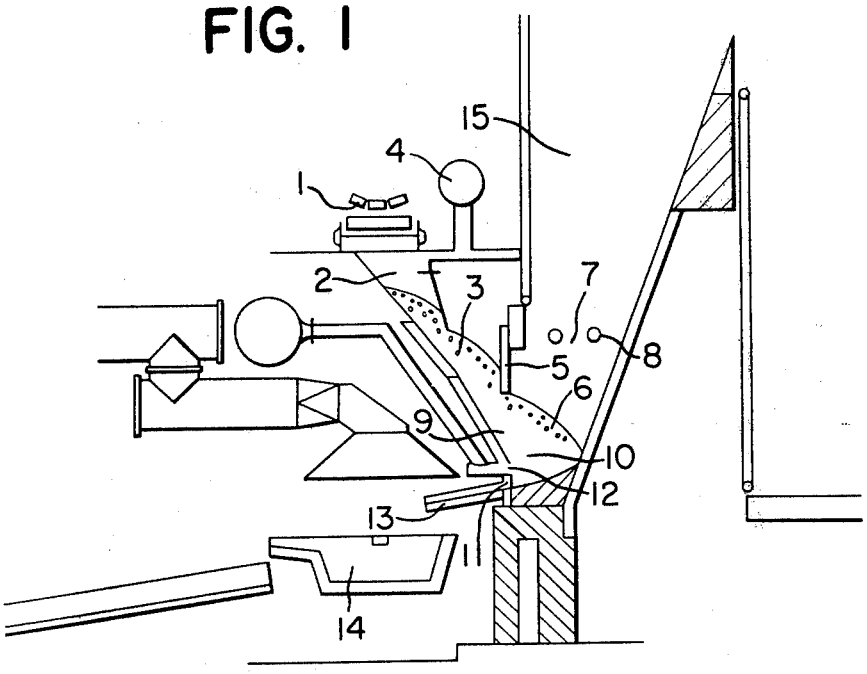
FIG. 1 is a cross-sectional view of an embodiment of the blast furnace according to the present invention, which also shows coker employed.
Figure 2:
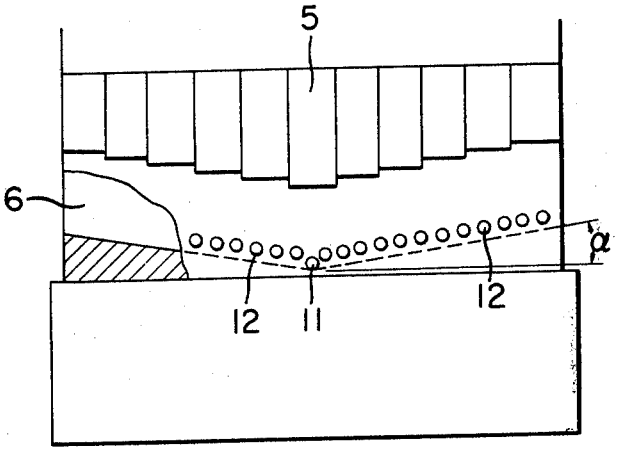
FIG. 2 is a diagrammatic view, partly broken away, illustrating the relation between the tuyere and the damper in the present invention.
Figure 4:
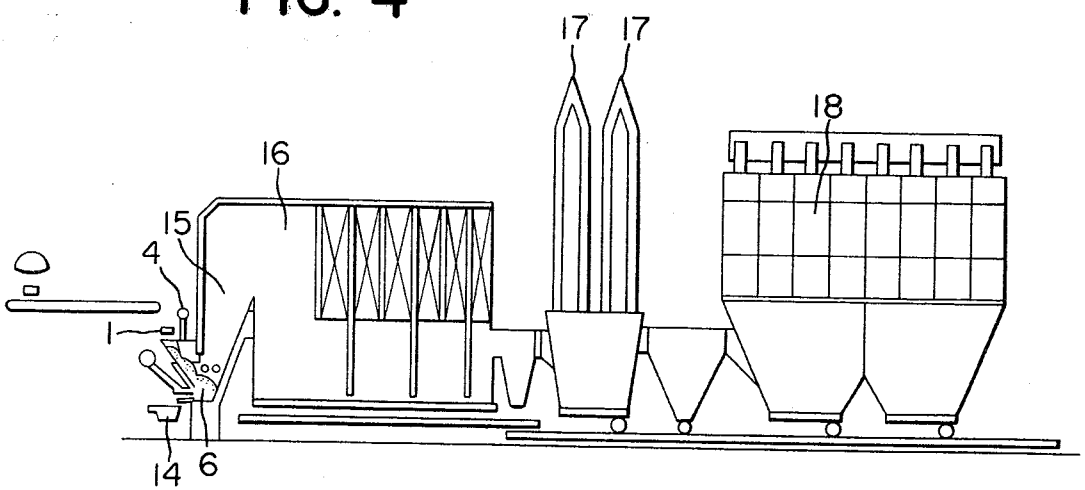
FIG. 4 is a diagrammatic view of an apparatus in accordance with the flow-sheet in FIG. 3.

The characteristic feature of the blast furnace in the present invention lies in the hearth, tuyere and damper thereof as set forth above. Therefore, the following will explain the details thereof by reference to FIGS. 1 and 2. To begin with, the hearth is inclined at a certain angle, to wit, $\alpha$ degrees (FIG. 2). Along this hearth are disposed the tuyeres 12. A tap hole 11 is disposed near the lowest part of the hearth either on the extension of an imaginary plane passing through the tuyeres 12 or slightly below it. The damper 5 is so designed that the fore end thereof conforms to the inclination of the hearth. This damper 5 functions to adjust the lengthwise thickness of the layer of ore fed to the furnace 6 and make it uniform. Also, it functions to partition the coking chamber 3 from the reaction zone 10, and the lower end portion thereof forms the ore inlet of the furnace. The blast furnace 6 is connected to a boiler 16 (FIG. 4) and a hairpin gas cooler 17 which constitute the waste heat recovering means and to a bag-house 18 which constitutes the volatile valuable metal recovering means, whereby the waste gas after oxidation/combustion within the oxidation zone 7 of the furnace effected by air blown in through the secondary air supply hole 8 is led to the baghouse 18 via the overhead clearance 15, boiler 16 and hairpin gas cooler 17 in that order.

In order to smelt a zinc containing waste material in a blast furnace as described above, it is desirable to form the material into briquettes having a superior crushing strength as a pretreatment. However, when the material to be subjected to smelting comprises the residue arising from pyrometallurgical smelting and the hydrometallurgical leaching residue with the addition of other zinc bearing material, it is difficult to obtain briquettes of good quality due to the difference of grain size, water content, etc. of the component materials.

In the prior art pretreatment of the residues arising from zinc smelting employing various processes as above, it is usual to apply the procedure in which the residue arising from pyrometallurgical smelting is sifted with a sieve having a mesh size of about 35 mm, the oversize resulting from the sifting is directly fed to the blast furnace while the undersize is fed to the furnace after a treatment comprising mixing it with the hydrometallurgical leaching residue together with fine coal and further adding thereto the ligno-sulfite liquor, followed by crushing with a double-roll crusher and mixing together, pressure extrusion by means of an auger for molding the mixture into cylindrical shape, cutting the resulting molding, and ageing by means of an ageing conveyor. According to this conventional procedure, however, the crushing becomes imperfect, causing unevenness of grain size and insufficiency of the kneading. Therefore, the pressure kneading must employ an auger, because the use of any other briquetting machine will cause undesirable adhesion or so-called 'clogging'. Besides, the kneading efficiency per unit machine is low, and further the crushing strength of the resulting briquette becomes insufficient, causing a lowering of the treating efficiency of the blast furnace.

In the light of the foregoing drawbacks in the prior art, it is particularly desirable that the briquetting of the material to be subjected to smelting in the present invention is performed by treating the material in such a way as follows.

Damp residue arising from pyrometallurgical smelting is sifted with a sieve having a mesh size of 20–40 mm, and the resulting undersize is first mixed with 80–100% of the total amount of ligno-sulfite liquor (sulfite liquor) to be employed. After adding thereto the remainder of said ligno-sulfite liquor, the mixture is subjected to primary mixing within a first rotary drier so as to attain a water content of 18–22%. Next, the thus dried mixture is subjected to secondary mixing within a second rotary drier together with hydrometallurgical leaching residue, other zinc containing materials and fine coal so as to attain a water content of 15–20%. Subsequently, the mixture resulting from the secondary mixing is crushed with a rod mill, kneaded with a kneader, and briquetted thereafter.

Figures 3, 3A, 3B:
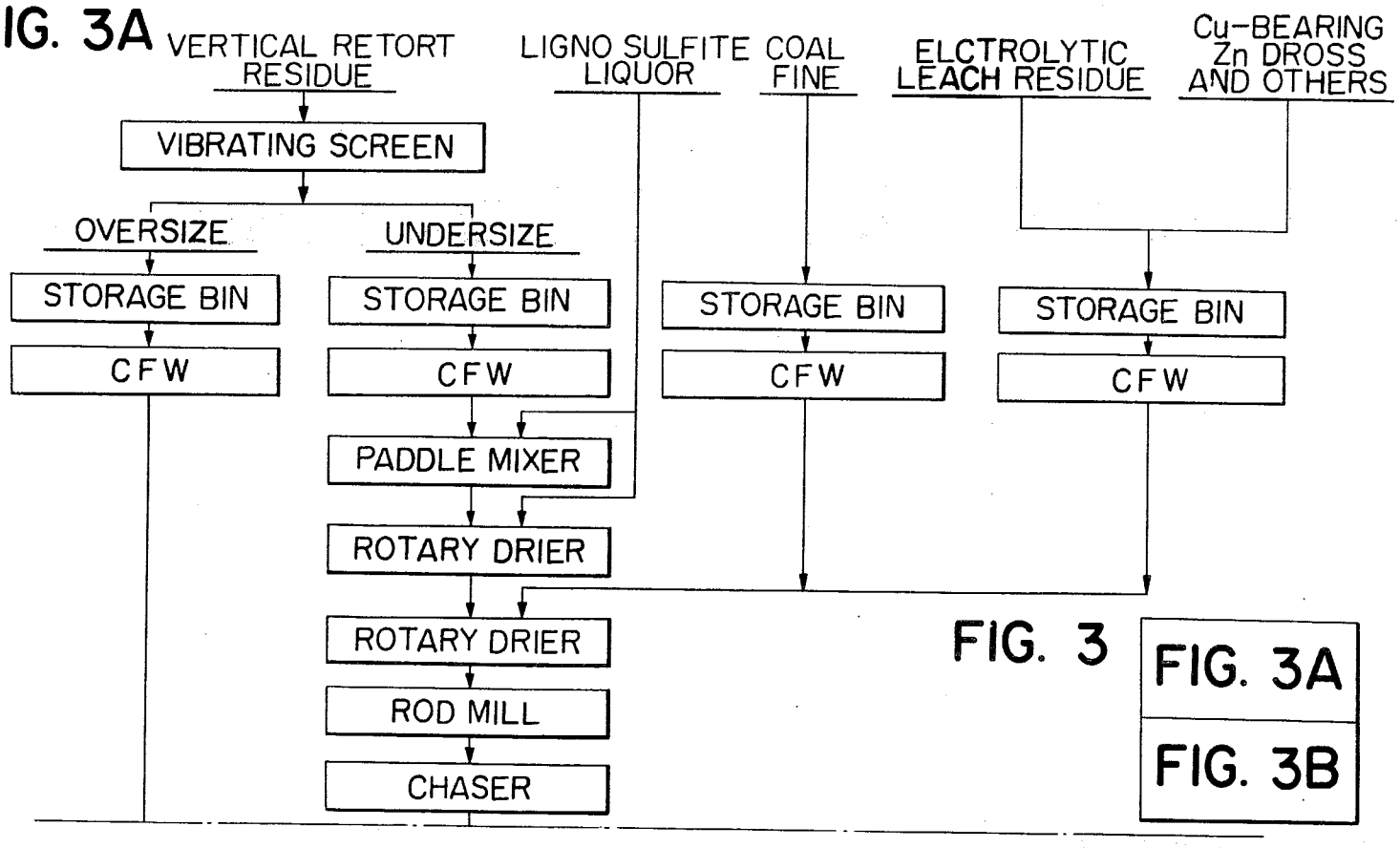
FIG. 3 is a block diagram showing the relationship of FIGS. 3A and 3B and FIGS. 3A and 3B are flow-sheets illustrating portions of the process of the present invention.
Figure 3B:
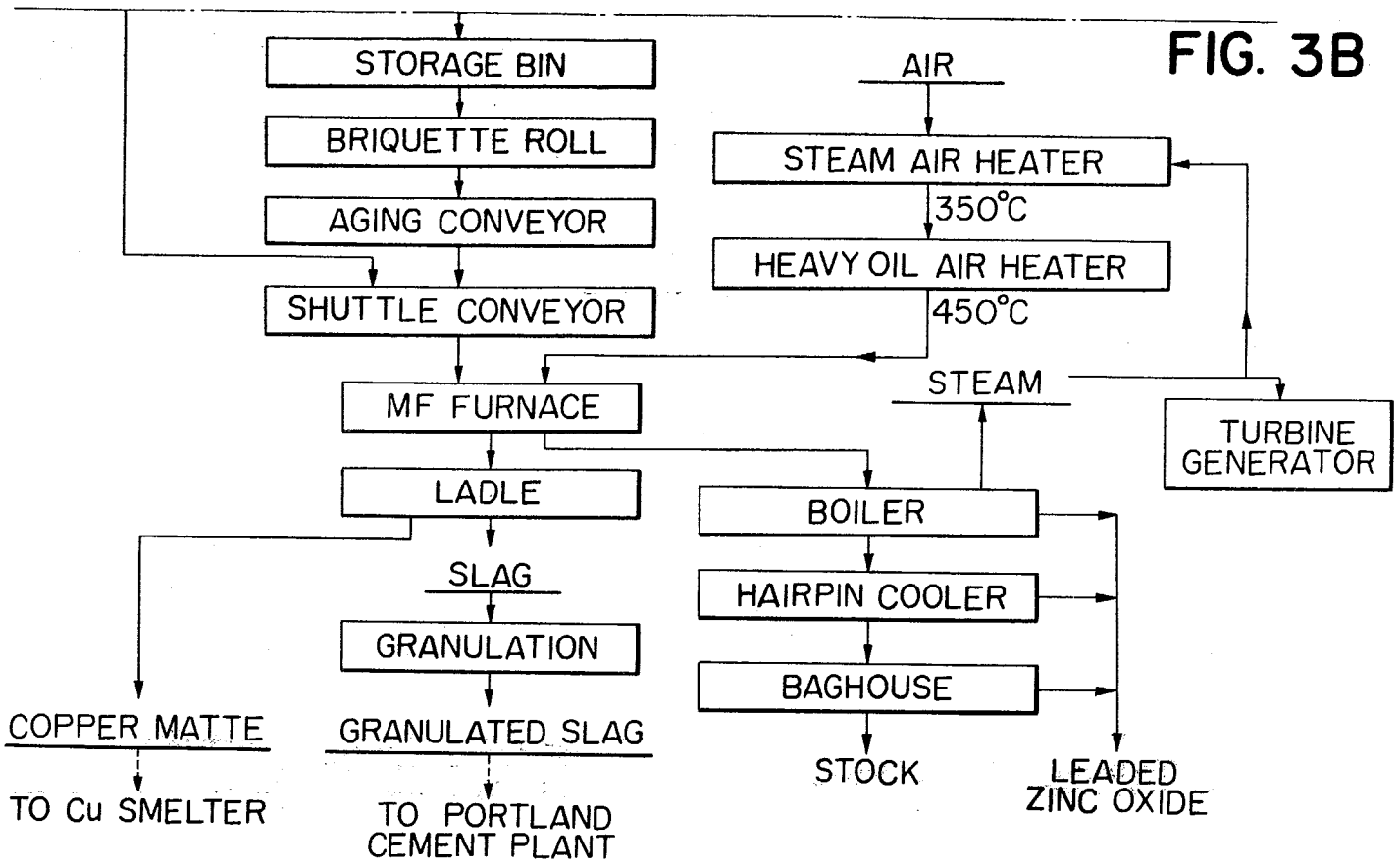

The foregoing pretreating process is further elucidated by reference to a part of the flow-sheet shown in FIG. 3.

The residue with a water content of 25–35% arising from pyrometallurgical smelting (namely, vertical retort distillation residue, horizontal retort distillation residue, electric thermal distillation residue) is sifted with a sieve having meshe size of 20–40 mm, preferably 35 mm, thereby separating it into oversize and undersize residue. As the sieve for this purpose, an oscillating sieve is optimum, but other sieves will do as well. The oversize needs no briquetting process and is therefore directly fed to the blast furnace.

The undersize is temporarily stored in the storage bin, and then is fed to the constant-volume mixer, e.g., a paddle mixer by means of a Constant-Feed-Weigher (CFW) while adding thereto the ligno-sulfite liquor. Addition of said undersize to the paddle mixer is conducted upon thoroughly mixing the sticky ligno-sulfite liquor with the residue beforehand so as to make the ligno-sulfite liquor permeate in the pores of the residue as much as possible. The amount of ligno-sulfite liquor added is sufficient to form a damp condition of the whole material to be briquetted, e.g., to the extent of 7–22% based on the dry volume of the total material to be briquetted, and 80–100%, preferably 90%, of the total amount of ligno-sulfite liquor to be employed is added to the paddle mixer. The larger is the amount of said ligno-sulfite liquor, the greater becomes the effect thereof as the binder, yet in a case where the amount of the ligno-sulfite liquor added is such that the liquid content of the mixture of more than 22%, there occurs said 'clogging' phenomenon within the rod mill, while in the case where it is less than 7%, the resulting briquetted ore becomes brittle. Consequently, it is preferable to adjust it to be about 18% after kneading.

Next, the mixture obtained by adding the ligno-sulfite liquor and kneading with the paddle mixer is fed to a first rotary drier together with the remainder of the ligno-sulfite liquor, preferably 10% of the total amount of ligno-sulfite liquor to be employed. This first rotary drier is preferably a heavy oil fired rotary drier. The drying is preferably performed in an atmosphere wherein the inlet temperature of hot gas is 650°–790° C. in the outlet temperature of same is 60°–100° C.

The essential point of the primary dry heating by means of the first rotary drier herein is that the drying of the kneaded mixture therein is conducted so as to adjust the water content thereof to be equivalent to the water content of the hydrometallurgical leaching residue to be added afterwards and the ligno-sulfite liquor is thoroughly permeated in the residue arising from dry smelting and is kneaded therewith. For instance, in the case where the water content of the hydrometallurgical leaching residue is 20%, the water content of the mixture after the primary drying is adjusted to about 20%. Practically speaking, in the primary mixing, the drying is conducted to attain a water content of 18–22%, preferably 20%, so as to agree with the water content of the hydrometallurgical leaching residue, whereby the water content of the mixture obtained in the primary mixing and that of the hydrometallurgical leaching residue to be added become practically equal at the time of conducting the secondary mixing and a satisfactory briquetting can be expected.

Next, the hydrometallurgical leaching residue and other zinc-containing materials having a water content of 18–25% and fine coal are fed to another rotary drier for the purpose of a secondary mixing.

Each of these materials is supplied from the respective storage bins by means of CFW and is adjusted so as to attain a gross carbon content of 18–22% (preferably 20%) and a zinc content of more than 10% (preferably more than 12%). Especially, an appropriate mixing ratio of the undersize residue to the hydrometallurgical leaching residue is necessary for obtaining briquettes of good quality, and a preferable ratio of the latter to the former is 1–12:1. The reason is that, in the case where a relatively coarse residue comprising 90% of more than 100-mesh grains and a relatively fine hydrometallurgical leaching residue comprising 90% of less than 100-mesh grains are mixed together, it is essential to prevent the occurrence of grain size segregation owing to the mixing ratio of the two and effect uniform distribution of the binder as well as the moisture on the surfaces of grains of the coarse residue thereby smearing said surface with the hydrometallurgical leaching residue.

As regards the carbon content, it is preferable to add excess carbon relative to an amount required for reducing the valuable metals and melting the ingredients of slag within the blast furnace, to wit, at a ratio of 20% of said required amount. As regards the zinc content, it depends on the amount of zinc contained in the residue arising from zinc smelting, and also it is determined by taking economy into consideration, yet it will suffice to contain more than 10%. The dust arising from iron manufacture and like materials are to be added secondarily so that the addition thereof is not necessarily required.

Thus the water content of the materials is reduced to 15–20%, preferably 17%, by the secondary drying, and besides, the mixture obtained from the primary mixing and the additional materials, i.e., hydrometallurgical leaching residue, etc. are thoroughly mixed together. The drying in the second drier is performed under the same conditions and by using a rotary drier of the same type as that of the first drier. In the case where the water content after the secondary drying is more than 20%, the viscosity of the mixture becomes so high that the 'clogging' phenomenon will take place in the kneading process thereafter, while in the case where it is less than 15%, the crushing strength of the briquette will be reduced, entailing cracking of the briquetted ore, and therefore, it is preferable to dry the material to the extent of attaining a water content of 17% and perform the mixing.

As against the prior art wherein the kneading process can utilize no more than a roll mill and the like, in the present invention, it is possible to use a pulverizer like a rod mill, etc. thereby pulverizing coarse grains in the mixture into a grain size akin to that of the hydrometallurgical leaching residue, and the thus more uniform grain size distribution has a good effect on the mixing and molding process.

Next, the pulverized mixture, is kneaded by means of a kneader, e.g., a chaser, so as to increase the density thereof to such an extent that it will attain an apparent specific gravity of 1.5 in respect to the material coming out of the chaser as compared with the apparent specific gravity 1.0 of the feed material, thereby increasing the strength of the resulting briquette.

Now, the process of briquetting the kneaded mixture will be explained. First, by using a molding machine, such as a briquetting roll equipped with 170 cups and comprising 2 pairs of rolls having a bore of 1 m and a breadth of 0.3 m, the kneaded mixture is formed into briquettes of, for instance, 220 g/ea. in weight and 80×50×35 mm in size. The molding pressure to be applied on this occasion is determined in the range of 2–3 t/cm according to the strength of the briquettes. The thus pressure molded briquettes are subjected to ageing at room temperature on an ageing conveyor for about 30 minutes and fed to the blast furnace.

In this way, the material attains a crushing strength of 30–100 Kg and becomes suitable for smelting by the blast furnace. However, the above described pre-treatment for briquetting purposes represents just one mode thereof. That is, the material to be subjected to the smelting process set forth later on is not limited to the briquetted ore obtained as above, and other various briquetted ores, lump ores, etc. are of course useful.

Next, a mode of effecting the coking of the material briquetted as above by utilizing a part of the waste gas of the blast furnace and performing the smelting of the thus coked ore material will be explained hereunder with reference to the appended drawings.

The material, or briquetted ore, is fed to the hopper zone 2 disposed above an extension of the coking zone by means of the shuttle conveyor 1. This hopper zone 2 has an effect of closing the furnace with briquetted ores and making the inside thereof airsealed. Subsequently, the briquette descends gradually within the hopper zone 2, and then enters the coking zone 3 wherein it is coked at a temperature of 500°–700° C. by means of a part of the waste gas of the furnace, its strength is increased, and the moisture as well as the volatile substances contained therein are removed. This coking zone 3 is defined by the walls of a water jacket. The waste gas of the coking zone 3 is absorbed by means of the by-pass flue 4. Besides, a part of the waste gas of the furnace is introduced into the coking zone 3 by virtue of the internal pressure of furnace maintained at a positive pressure, and is utilized as the heat source for heating the briquettes. The by-pass flue 4 is connected to the inlet of a bag-house to be described later, whereby the waste gas absorbed thereby is supposed to be mixed with the main waste gas. The degree of the coking is adjusted through adjustment of the amount of waste gas passing the coking zone 3 by increasing or decreasing the internal pressure of the furnace within the positive range; for instance, by maintaining the internal pressure of the upper part of furnace at a positive pressure of +2–5 m water column, the gasflow of the by-pass is adjusted to 5–10% of the total gasflow and an ideal condition for coking can be obtained.

Next, the thus coked briquettes are continuously supplied to the blast furnace 6 at a temperature of 500°–700° C. while the thickness of the layer thereof along the length of the furnace is adjusted by the iron damper 5 of the water jacket. The briquettes supplied to the blast furnace 6 slip down the inclined side 9 while its temperature is further raised by the ascending flow of gas, and as soon as there occurs the reduction volatilization of zinc, it descends within the furnace and is held at a high temperature of more than 1,300° C. in the reaction zone 10. Simultaneously with the volatilization of zinc and the combustion of carbon, there occurs the reduction of iron contained in the briquetted ore and a part of the thus reduced metallic iron accumulates on the bottom of furnace, while the remainder is consumed in reacting with zinc sulfide and lead sulfide except for a small portion which turns into semi-fused state and is discharged through the tap hole 11. When the metallic iron accumulating at the bottom of furnace attains a height close to the level of tuyere, there takes place oxidation by virtue of the blast coming in through the tuyere 12, and the resulting ferrous oxide fuses into slag and is discharged through the tap hole 11, whereby generation and consumption of the metallic iron are always balanced. Inasmuch as the surface of the hearth covered with metallic iron is inclined toward the tap hole 11 along the current of blast coming in through the tuyeres 12, the melt consisting of slag and matte containing non-volatile valuable metals like gold, silver, copper, etc. flows toward the tap hole 11 while forming a thin layer on the surface of hearth. During its flow, the melt is agitated by the air from the tuyeres 12 to come in through contact with the metallic iron on the hearth as well as carbon monoxide gas, causing zinc, cadmium and lead contained therein to volatalize, and is finally discharged into the ladle 14 from the tap hole 11 via the trough 13.

A plurality of tuyeres 12 are arranged on the datum line thereof having an angle of inclination in the range of 2°-10°, preferably 4°, as illustrated in FIG. 2. The interval of tuyeres is preferably 300 mm, but it is not particularly limited. The number of the tuyeres is determined based on the airflow of the tuyeres to be required for performing the smelting of material ingredients contained in the briquette by means of the blast furnace, and the airflow velocity of the pre-heated air coming in through the tuyere is preferably in the range of 40-60 m/sec. The bottom of the furnace and the fore end of damper are also inclined in conformity with the datum line of the tuyeres.

It is a characteristic feature of the present invention to incline the datum line of tuyeres by a certain angle. By virtue of thus inclining the tuyeres, a delay of the smelting reaction with an increase of the feed of ores in the vicinity of the tuyeres on the side parts along the length of furnace, which delay would entail the so-called 'dead' phenomenon of tuyeres, such as seen in the conventional blast furnace having horizontally arranged tuyeres, can be eliminated.

However, if the angle formed between the datum line of tuyeres and the horizontal direction is too great, the smelting reaction at the two side parts of the furnace will become intense compared with the central part thereof, entailing a lowering tendency of the smelting speed in the central part.

In the case of the conventional half-shaft furnace, if the length of the furnace is extended, the smelting reaction at the tuyere portion will be dulled due to unsatisfactory forming of slag and matte and in its turn there will occur a complete suspension of the reaction, and therefore, it has been difficult to enlarge the size of the furnace. On the contrary, according to the present invention, by inclining the datum line of the tuyeres, the smelting reaction can be satisfactorily effected at every tuyere and, accordingly, there is no need to lessen the thickness of the layer of ore. This is a unique feature not found in the prior art.

When the temperature of the hearth rises excessively, it is possible that semi-fused metallic iron flow out of the tap hole 11. But, inasmuch as air is being blown into the furnace through the tuyeres 12 and a part of said air is always blowing out through the tap hole 11, the oxidation of metallic iron takes place at the tap hole 11 and the trough 13 as well and, as a result, clogging of the outlet of furnace due to accumulation of the metallic iron and the outflow of the metallic iron to the ladle 14 will not take place. The matte comprising 5% of Cu, 800 g/t of Ag which is included in the melt discharged into the ladle 14 through the tap hole 11 is accumulated within the ladle 14, while the slag overflows and is separately supplied to a hydraulic granulater trough.

Meanwhile, a high-temperature gas containing zinc vapor which has ascended through the layer of ore within the blast furnace 6 flows from the surface of the layer of ore and is oxidized within the oxidation zone 7 by the air blowing out through the secondary air supply hole 8 provided with the oxidation zone 7. And, at the same time, the metal sulfides volatilized in the blast furnace 6, i.e., such volatile substances as lead sulfide, tin sulfide, cadmium sulfide, etc., are also oxidized. All of these volatile substances oxidized as described above pass the overhead clearance 15 in the furnace, turn into a gas having a temperature of 1,100°-1,250° C., and are introduced into the boiler 16 constituting a waste heat recovering means which is connected to said overhead clearance 15 in the furnace. In this boiler 16, said high-temperature gas is cooled down to about 300° C., and the thus cooled waste gas is further cooled down to 170°-200° C. in the hairpin gas cooler 17, mixed with the by-pass flue gas and cold air at the inlet of the bag-house 18 so as to have a temperature of 100°-110° C., and then are introduced into the bag-house 18 where the volatile valuable metal oxides like zinc, etc. contained in the waste gas are collected. In this connection, when the recovery of metallic zinc is desired, the blowing-in of air through the secondary air supply hole 8 is suspended and a condenser is mounted on the outlet for the waste gas.

The overhead clearance 15 of the furnace functions as a combustion chamber for volatile metals like zinc, etc., metal sulfides and carbon monoxide and concurrently as a precipitation chamber for scattered dust, and therefore, it is amply spacious so as to be capable of improving the quality of products from the zinc oxide. Besides, this overhead clearance 15 is connected to the boiler 16 thereby to play a role of radiation heat source for the boiler 16 as well.

Figure 5:
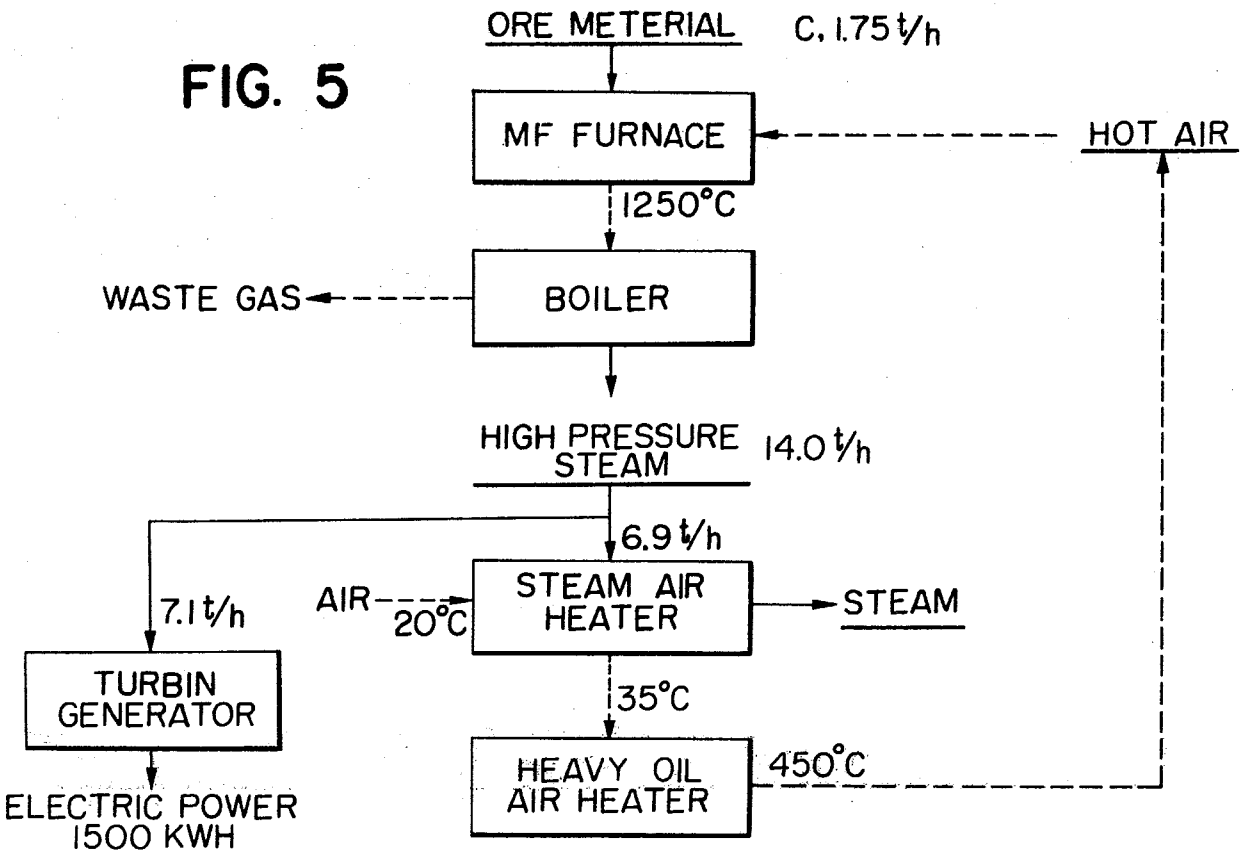
FIG. 5 is a flow-sheet of the heat recovery steps.

Next, the process of recovering heat of the high-temperature waste gas arising from the blast furnace 6 will be explained with reference to FIG. 5. In FIG. 5, the arrow with solid line expresses the flow of steam, ore material and electricity, and the arrow with dotted line expresses the flow of gas and air. Referring to the drawing, the waste gas of about 1,250° C. coming out of the blast furnace 6 is subjected to heat exchange in the boiler 16 thereby to generate a high-pressure steam of 35-40 $Kg/cm^2$ per 7-9 t/ct of combusted carbon. The waste gas after heat exchange is sent to the hairpin gas cooler 17 as set forth above. Meanwhile, the high-pressure steam generated as above is introduced into the steam air heater 19 wherein air is pre-heated up to about 350° C. The thus pre-heated air is further heated within the heavy oil air heater 20 up to more than 450° C., and is thereafter supplied to the blast furnace 6 by way of the tuyeres 12 of said furnace. A part of the high-pressure steam generated in the boiler 16 is supplied to the turbine generator, whereby electric power of 4.5-5 KWH/Kg of steam is generated.

In the smelting process of the present invention as described above, what constitutes a particularly important condition is to carbonize and preheat a briquetted ore having a sufficient strength in the coking zone, whereby to enhance the efficiency of the hearth, and to maintain a uniform flow of air flow from the tuyeres arranged along the datum line inclined in the direction of the length of the furnace. In this way, the length of the furnace can be drastically elongated, metal sulfides, zinc vapor, carbon monoxide, etc. can be oxidized and combusted by the secondary air within the spacious overhead clearance of the furnace, and the ore material fed in can be maintained at a high temperature by virtue of the heat generated in the reaction zone together with the heat arising from oxidation and combustion.

As regards the controlling system for the purpose of maintaining the layer of ore at a high temperature, by controlling the amount of the waste gas to be alotted for circulation to the coking zone (by-pass ratio) as well as the overhead pressure within the furnace, the temperature of the ore material fed to the furnace is maintained at a temperature of 500°–700° C. and the temperature of the reaction zone at more than 1,300° C. Furthermore, adoption of such conditions as preheating of the air to be blown in through the tuyeres up to more than 450° C., making uniform the flow of air blasts from the tuyeres, arrangement of the tuyeres at a low position close to the hearth, and continuous discharge of the melt produced in the furnace without retaining it on the bottom of furnace, provides for an efficient operation.

The furnace in the present invention can be either a single-sided tuyere type blast furnace or a double-sided tuyere type blast furnace. However, in the case of applying the latter, the blast efficiency increases particularly, but it calls for the provision of a protuberant portion of the brick bed at the central part of the furnace like in the case of the conventional blast furnaces, entailing a trouble with respect to the discharge of the waste gas of the furnace.

As will be understood from the above description, according to the present invention, by virtue of the blast sent in through the tuyeres, the smelting reaction within the furnace is made uniform, the blast efficiency increases drastically, and valuable metals can be economically recovered from zinc bearing materials.

Hereunder will be given an example embodying the present invention.

EXAMPLE

To begin with, the analytic values of valuable metals contained in the starting material residue and so on employed in the present example were as follows.

| | Zn(%) | Fe(%) | Pb(%) | Cu(%) | T-S(%) | C(%) | Au(g/t) | Ag(g/t) |
|---|---|---|---|---|---|---|---|---|
| oversize of vertical retort residue | 4.20 | 12.0 | 4.1 | 1.0 | 5.1 | 29.5 | 0.3 | 130 |
| undersize of vertical retort residue | 3.88 | 13.2 | 4.3 | 0.9 | 5.1 | 27.5 | 0.3 | 131 |
| electrolytic zinc leaching residue | 19.6 | 23.4 | 3.4 | 0.9 | 5.8 | — | 0.4 | 206 |
| dust from iron manufacture | 26.8 | 12.3 | 3.4 | 0.2 | 1.0 | — | — | — |

After sifting 320 t/day, in dry volume, of the residue arising from vertical retort distillation process (water content: 30%) with a 35 mm-mesh oscillating sieve (specification: low-head, single-deck type, capacity: 100 t/h, size: 4 ft×10 ft, frequency: 780 cycle/min.), 220 t/day of the undersize (to wit, 32.8% of the gross feed) were mixed with a ligno-sulfite liquor (carbon content: 40%, ash content: 17%, $Na_2SO_4$: balance, solid content: 50%) in an amount of 16% based on the material-to-be-briquetted (to wit, 89% of the gross amount of ligno-sulfite liquor employed) by means of a paddle mixer (number of rotation: 60 r.p.m. capacity: 30 t/h, power: 22 KW, paddle: 450 nmϕ in diameter×2 rows) while adding said ligno-sulfite liquor to the undersize, whereby the ligno-sulfite liquor was thoroughly permeated among the undersize grains and mixed therewith. Subsequently, the resulting mixture was put in the first heavy-oil fired rotary drier (inside diameter: 3 m, length: 25 m, parallel flow type). On this occasion, the remaining ligno-sulfite liquor was added to the mixture to establish that the amount of the added ligno-sulfite liquor is 18% in dry volume (gross amount: 102.6 t, solid content: 51.3 t), and mixing was performed so as to make the ligno-sulfite liquor permeate thoroughly in the porous surface of the residue while adjusting the gas temperature at the inlet of the drier to 750° C. and drying to the extent of attaining a water content of 20%.

Next, this mixture obtained from the first rotary drier was put in the second rotary drier (with the same specifications as the first rotary drier) together with 250 t/day, in dry volume, of the electrolytic zinc leaching residue (water content: 20%, grain size: 90% of 100-mesh grains), 15 t/day of dust arising from iron manufacture (zinc-containing dust, water content: 20%, grain size: 80% of 100-mesh grains) and 33.7 t/day, in dry state, of fine coal (water content: 15%, carbon content: 70%, grain size: 50% of 100-mesh grains) supplied from their respective CFW while adjusting their respective feed rates so as to make the ore material within the furnace contain 20% of carbon and more than 10% of zinc. Subsequently, by adjusting the inlet temperature of the furnace to 700° C., a thorough dry mixing of these materials was conducted. As a result, the water content of the mixture after the second drying was maintained at 17%.

Next, this mixture after the second drying was put in a parallel located-rod mills (specification: inside diameter: 2.4 m, length: 3.8 m, capacity: 22 t/h, rubber lining). This mixture containing 18% of ligno-sulfite liquor did not adhere to the inside of said rod mill, and it was possible to perform 2,000 hours' consecutive operation. Within the rod mill, there progressed the work of pulverizing the mixture so as to approximate the grain size of relatively coarse grains of the residue arising from dry smelting process to that of the electrolytic zinc leaching residue (red residue) together with the work of uniformly permeating the ligno-sulfite liquor in the whole mixture while preventing the occurrence of clogging, or 'incrustation' of the red residue onto the inside of the rod mill arising from the mixing of the electrolytic zinc leaching residue with a high-density ligno-sulfite liquor.

Next, the thus treated mixture was thoroughly kneaded with a chaser (specification: a pair of rolls, each roll having inside diameter of 1.6 m and width of 1 m; inside diameter of pan: 3.87 m). On this occasion, in order to obtain briquettes of good quality in the briquetting process, the water content of the mixture was made more uniform by adding water at the rate of 0–100 l/min. while kneading.

The thus kneaded ore material was stored in a storage bin for ageing, and, after densification, it was supplied to 5-unit briquetting rolls (consisting of 2 pairs of rolls, each roll having inside diameter of 1 m and width of 0.3 m; equipped with 170 cups each) for pressure molding into oval briquettes (sized 80 mm×50 mm×35 mm, and weighing 220 g/ea.) under a specific pressure of 3 t/cm, whereby there were obtained 570 t of briquettes (with Zn content of 11% and C content of 20%).

By putting 180 t of said 570 t of briquettes together with 30 t/day of oversize lumps into the hopper zone by means of a shuttle conveyor and subsequently putting the same into the coking zone, coking was effected at 700° C. The volume of the by-pass blast passing the coking zone was set at 7.5% based on the main waste gas. Next, the material subjected to the coking was put in a blast furnace having its datum line inclined at an angle of 4 degrees and provided with 26 tuyeres disposed bilaterally along the tap hole, to wit, 13 tuyeres on the respective sides. By blowing a hot blast preheated up to a temperature of 450° C. through these tuyeres at the rate of 220 $Nm^3$/min. (inflow velocity at the tuyere: 50 m/sec.), the temperature of the reaction zone was maintained at more than 1,300° C.

The melt was continuously discharged into a ladle outside the furnace, and matte was separated from slag. The waste gas coming out of the furnace showed a temperature of 1,250° C. This waste gas was cooled down to 270° C. in a boiler and further cooled down to 180° C. in a hairpin gas cooler. By mixing the thus cooled waste gas with the by-pass flue gas, adjusting its temperature to 105°-110° C. at the inlet of a bag-house, and introducing it into the bag-house, coarse zinc oxide could be recovered. In the above operation, the material could be treated at the rate of 210 t/day, and this operation could be performed for 90 consecutive days without any trouble.

The result of operation in the present example was shown in the following table in comparison with the result of operation employing the conventional blast furnace.

As will be understood from the showings in this table, the smelting efficiency of a blast furnace according to the present invention is drastically improved.

Table

| | Present Example | | | | | | | Comparative Example | | | | | |
|---|---|---|---|---|---|---|---|---|---|---|---|---|---|
| 1. Ore material | | | | | | | | | | | | | |
| briquetted ore | 180 t/day per furnace | | | | | | | 50 t/day per furnace | | | | | |
| oversize lump ore arising from vertical retort distillation process | 30 t/day per furnace | | | | | | | 30 t/day per furnace | | | | | |
| | total 210 t/day per furnace | | | | | | | 80 t/day per furnace | | | | | |
| 2. Product | | | | | | | | | | | | | |
| coarse zinc oxide | 34 t/day per furnace | | | | | | | 14 t/day per furnace | | | | | |
| matte | 30 t/day per furnace | | | | | | | 12 t/day per furnace | | | | | |
| slag | 63 t/day per furnace | | | | | | | 35 t/day per furnace | | | | | |
| | total 127 t/day per furnace | | | | | | | 61 t/day per furnace | | | | | |
| 3. Analysis | Zn %, | Fe %, | Pb %, | Cu %, | Ag g/t, | Au g/t, | C % | Zn %, | Pb %, | Cu %, | Ag g/t, | Au g/t, | C % |
| feed material | 9.9 | 15.2 | 3.4 | 0.9 | 139 | — | 20 | 12 | 2 | 1 | 250 | — | 28 |
| coarse zinc oxide | 52 | — | 19 | — | 90 | — | — | 60 | 10 | — | 100 | — | — |
| matte | 3 | — | 1.5 | 5.0 | 700 | 0.6 | — | 2.5 | 1.2 | 6 | 1,330 | 2 | — |
| slag | 3.5 | — | 0.3 | 0.25 | 30 | — | — | 3.0 | 0.3 | 0.22 | 74 | — | — |
| 4. Recovery | Zn | | Pb | Cu | | Ag | | Zn | | Pb | Cu | Ag | |
| 83% (coarse zinc oxide) | 90% (coarse zinc oxide) | | 90% matte | 80% matte | | 12% (coarse zinc oxide) | | 85% | | 96% | 90% | 80% | |
| 5. Condition for operation | | | | | | | | | | | | | |
| number of tuyere | 26 | | | | | | | 14 | | | | | |
| length of furnace | 7.8 m | | | | | | | 4.2 m | | | | | |
| efficiency of hearth | 27 t/m | | | | | | | 19 t/m | | | | | |
| airflow at tuyere, primary | 220 $Nm^3$/min. | | | | | | | 110 $Nm^3$/min. | | | | | |
| airflow at tuyere, secondary | 60 $Nm^3$/min. | | | | | | | 30 $Nm^3$/min. | | | | | |
| pressure at tuyere | 0.5 m water column | | | | | | | 0.3 m water column | | | | | |
| temperature of primary air | 450° C. | | | | | | | 200° C. | | | | | |
| temperature of overhead of furnace | 1,250° C. | | | | | | | 1,100° C. | | | | | |
| temperature at outlet of a boiler | 270° C. | | | | | | | — | | | | | |
| temperature at outlet of hairpin cooler | 180° C. | | | | | | | — | | | | | |
| recovery rate of steam | 14.0 t/h | | | | | | | — | | | | | |
| steam per unit of a carbon | 8 t/ct | | | | | | | — | | | | | |
| electric power 4.7 KWH/Kg unit Kg of steam | | | | | | | | | | | | | |

What is claimed is:

1. A method for separating and recovering volatile valuable metals including zinc and non-volatile valuable metals from zinc-bearing materials, utilizing a blast furnace comprising a horizontally elongated hearth whose upper surface is inclined downwardly relative to the horizontal in the lengthwise direction of said hearth toward tap hole means and an array of tuyeres disposed in horizontally spaced-apart relation along the lengthwise extent of said hearth and disposed closely above said upper surface of said hearth, said array of tuyeres being inclined relative to the horizontal at substantially the same angle as said upper surface of said hearth, which comprises the steps of: feeding briquettes of said zinc-bearing material containing carbonaceous material admixed therewith through a coking zone which communicates with said blast furnace and in said coking zone heating the briquettes by contact with hot waste gas flowing upwardly from said blast furnace; then flowing a thin layer of the coked briquettes downwardly from the coking zone into the blast furnace toward the hearth to form a bed of said briquettes in a reaction zone above said hearth, said layer being of substantially uniform thickness along the lengthwise extent of said hearth, and simultaneously blowing preheated air through said tuyeres into said blast furnace in a lateral direction above the upper surface of said hearth so that the zinc in said zinc-bearing material is reduced to zinc metal and is evaporated and non-volatile materials present in said zinc-bearing material become molten and collect on said hearth and flow toward said tap hole means and simultaneously are contacted by the preheated air supplied through said tuyeres to form an agitated melt from which volatile metals are evaporated; flowing the vaporized volatile metals upwardly through said blast furnace and recovering said metals outside said furnace.

2. The method of claim 1 wherein the upper surface of said hearth and said array of tuyeres both have the shape of a shallow V and the tap hole means is located at the longitudinal mid-portion of said hearth, whereby said melt flows along the legs of said V toward said tap hole means.

3. The method of claim 2 including the step of blowing secondary air into the upper portion of said blast furnace in reactive contact with the vaporized volatile metals flowing upwardly therethrough whereby to oxidize said volatile metals.

4. The method of claim 3 including the steps of flowing the vaporized volatile metals and hot waste gases produced in the blast furnace into a waste heat recovery means and utilizing same to generate high-pressure steam therein, preheating the air blown into said blast furnace with a portion of said steam and flowing the remainder of said steam through a turbine generator to generate electric power.

5. The method of claim 3 wherein the upper surface of said hearth and said array of tuyeres are inclined at an angle of from 2° to 10° relative to the horizontal, and wherein the briquettes are heated to a temperature of 500° to 700° C. in said coking zone, the temperature in the reaction zone of the blast furnace is higher than 1300° C., the temperature of said preheated air is higher than 450° C. and the flow velocity of the preheated air supplied through the tuyeres is from 40 to 60 m/sec.

6. A method for separating and recovering volatile valuable metals including zinc and non-volatile valuable metals from zinc-bearing materials, utilizing a blast furnace comprising a horizontally elongated hearth whose upper surface is inclined downwardly relative to the horizontal in the lengthwise direction of said hearth toward tap hole means and an array of tuyeres disposed in horizontally spaced-apart relation along the lengthwise extent of said hearth and disposed closely above said upper surface of said hearth, said array of tuyeres being inclined relative to the horizontal at substantially the same angle as said upper surface of said hearth, which comprises the steps of: screening residue from the pyrometallurgical smelting of zinc ore to obtain an undersize fraction having a particle size of less than 20 mm and an oversize fraction having a larger particle size; admixing ligno-sulfite liquor with the undersize fraction and then drying that mixture in a first rotary drier to a water content of from 18 to 22%, the total amount of said ligno-sulfite liquor being from 7 to 22%, based on the amount of said undersize fraction, with from 80 to 100% of the total ligno-sulfite liquor being admixed with said undersize fraction and the balance of the ligno-sulfite liquor being added in said first rotary drier; placing into a second rotary drier the mixture of undersize fraction and ligno-sulfite liquor obtained in said first rotary drier, together with hydrometallurgical zinc leaching residue and pulverized coal to form a second mixture having a carbon content of 18 to 22% and a zinc content of more than 10% and drying said second mixture to a water content of from 15 to 20%; pulverizing the second mixture obtained in the second rotary drier with a rod mill, kneading the thus-pulverized second mixture with a kneader and briquetting the kneaded mixture to obtain briquettes; feeding said briquettes and said oversize fraction through a coking zone which communicates with said blast furnace and in said coking zone heating the briquettes and said oversize fraction by contact with hot waste gas flowing upwardly from said blast furnace; then flowing a thin layer of the coked briquettes and said oversize fraction downwardly from the coking zone into the blast furnace toward the hearth to form a bed of said briquettes and said oversize fraction in a reaction zone above said hearth, said layer being of substantially uniform thickness along the lengthwise extent of said hearth, and simultaneously blowing preheated air through said tuyeres into said blast furnace in a lateral direction above the upper surface of said hearth so that the zinc in said briquettes and oversize fraction is reduced to zinc metal and is evaporated and non-volatile materials present in said briquettes and oversize fraction become molten and collect on said hearth and flow toward said tap hole means and simultaneously are contacted by the preheated air supplied through said tuyeres to form an agitated melt from which volatile metals are evaporated; flowing the vaporized volatile metals upwardly through said blast furnace and recovering said metals outside said furnace.

7. The method of claim 6 wherein the upper surface of said hearth and said array of tuyeres both have the shape of a shallow V and the tap hole means is located at the longitudinal mid-portion of said hearth, whereby said melt flows along the legs of said V toward said tap hole means.

8. The method of claim 6 including the step of blowing secondary air into the upper portion of said blast furnace in reactive contact with the vaporized volatile metals flowing upwardly therethrough whereby to oxidize said volatile metals.

9. The method of claim 8 including the steps of flowing the vaporized volatile metals and hot waste gases produced in the blast furnace into a waste heat recovery means and utilizing same to generate high-pressure steam therein, preheating the air blown into said blast furnace with a portion of said steam and flowing the remainder of said steam through a turbine generator to generate electric power.

10. The method of claim 8 wherein the upper surface of said hearth and said array of tuyeres are inclined at an angle of from 2° to 10° relative to the horizontal, and wherein the briquettes are heated to a temperature of 500° to 700° C. in said coking zone, the temperature in the reaction zone of the blast furnace is higher than 1300° C., the temperature of said preheated air is higher than 450° C. and the flow velocity of the preheated air supplied through the tuyeres is from 40 to 60 m/sec.

* * * * *

UNITED STATES PATENT AND TRADEMARK OFFICE

CERTIFICATE OF CORRECTION

PATENT NO. : 4 164 418

DATED : August 14, 1979

INVENTOR(S) : Hiroshi Tokunaga et al

It is certified that error appears in the above-identified patent and that said Letters Patent are hereby corrected as shown below:

Column 16, line 47; change "claim 6" to

---claim 7---.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*